US009777960B2

(12) United States Patent
Currence et al.

(10) Patent No.: US 9,777,960 B2
(45) Date of Patent: Oct. 3, 2017

(54) NGL RECOVERY FROM NATURAL GAS USING A MIXED REFRIGERANT

(75) Inventors: Kevin L. Currence, Olathe, KS (US); Robert A. Mortko, Olathe, KS (US)

(73) Assignee: BLACK & VEATCH HOLDING COMPANY, Overland Park, KS (US)

( * ) Notice: Subject to any disclaimer, the term of this patent is extended or adjusted under 35 U.S.C. 154(b) by 100 days.

(21) Appl. No.: 13/308,982

(22) Filed: Dec. 1, 2011

(65) Prior Publication Data

US 2012/0137726 A1 Jun. 7, 2012

Related U.S. Application Data

(60) Provisional application No. 61/418,444, filed on Dec. 1, 2010.

(51) Int. Cl.
*F25J 3/02* (2006.01)

(52) U.S. Cl.
CPC ..... *F25J 3/0209* (2013.01); *F25J 3/0219* (2013.01); *F25J 3/0233* (2013.01); *F25J 3/0238* (2013.01); *F25J 3/0242* (2013.01); *F25J 2200/02* (2013.01); *F25J 2200/72* (2013.01); *F25J 2200/74* (2013.01); *F25J 2205/04* (2013.01); *F25J 2210/12* (2013.01); *F25J 2230/30* (2013.01); *F25J 2245/02* (2013.01); *F25J 2270/04* (2013.01); *F25J 2270/12* (2013.01); *F25J 2270/66* (2013.01)

(58) Field of Classification Search
USPC ..... 62/611, 613, 614, 616, 617, 618, 619, 62/620, 625, 630, 632
See application file for complete search history.

(56) References Cited

U.S. PATENT DOCUMENTS

| | | | | |
|---|---|---|---|---|
| 3,191,395 | A | 6/1965 | Maher et al. | |
| 3,210,953 | A | 10/1965 | Reed | |
| 3,271,967 | A | 9/1966 | Karbosky | |
| 3,596,472 | A | 8/1971 | Streich | |
| 3,729,944 | A * | 5/1973 | Kelley et al. | 62/630 |
| 3,800,550 | A | 4/1974 | Delahunty | |
| 3,915,680 | A | 10/1975 | Crawford | |
| 3,932,154 | A | 1/1976 | Coers et al. | |
| 4,033,735 | A * | 7/1977 | Swenson | 62/612 |
| 4,036,028 | A | 7/1977 | Mandrin | |

(Continued)

FOREIGN PATENT DOCUMENTS

| | | |
|---|---|---|
| JP | 2000-018049 | 1/2000 |
| JP | 2002-005398 | 1/2002 |

(Continued)

OTHER PUBLICATIONS

International Search Report & Written Opinion for PCT/US2011/062861, dated Jul. 16, 2012, 7 pages.

(Continued)

*Primary Examiner* — John F Pettitt
(74) *Attorney, Agent, or Firm* — Hovey Williams LLP

(57) ABSTRACT

An NGL recovery facility utilizing a single, closed-loop mixed refrigerant cycle for recovering a substantial portion of the $C_2$ and heavier or $C_3$ and heavier NGL components from the incoming gas stream. Less severe operating conditions, including a warmer refrigerant temperature and a lower feed gas pressure, contribute to a more economical and efficient NGL recovery system.

15 Claims, 1 Drawing Sheet

(56) References Cited

U.S. PATENT DOCUMENTS 4,157,904 A 6/1979 Campbell
4,217,759 A 8/1980 Shenoy
4,249,387 A 2/1981 Crowley
4,278,457 A 7/1981 Campbell
4,311,496 A 1/1982 Fabian
4,411,677 A 10/1983 Pervier et al.
4,525,187 A 6/1985 Woodward et al.
4,584,006 A * 4/1986 Apffel ..... 62/628
4,662,919 A 5/1987 Davis
4,664,686 A 5/1987 Pahade
4,666,483 A * 5/1987 Gauthier ..... 62/622
4,676,812 A 6/1987 Kummann
4,707,170 A 11/1987 Ayres et al.
4,714,487 A * 12/1987 Rowles ..... 62/627
4,720,294 A 1/1988 Lucadamo et al.
4,727,723 A 3/1988 Durr
4,869,740 A 9/1989 Campbell et al.
4,878,932 A 11/1989 Phade
5,051,120 A 9/1991 Pahade
5,148,680 A 9/1992 Dray
5,182,920 A 2/1993 Matsuoka et al.
5,275,005 A 1/1994 Campbell et al.
5,351,491 A 10/1994 Fabian
5,377,490 A 1/1995 Howard et al.
5,379,597 A 1/1995 Howard et al.
5,398,497 A 3/1995 Suppes
5,497,626 A 3/1996 Howard et al.
5,502,972 A 4/1996 Howard et al.
5,520,724 A 5/1996 Bauer et al.
5,555,748 A 9/1996 Campbell et al.
5,566,554 A 10/1996 Vijayaraghavan et al.
5,568,737 A 10/1996 Campbell et al.
5,596,883 A 1/1997 Bernhard
5,615,561 A 4/1997 Houshmand et al.
5,657,643 A * 8/1997 Price ..... 62/612
5,771,712 A 6/1998 Campbell et al.
5,791,160 A 8/1998 Mandler et al.
5,799,507 A 9/1998 Wilkinson et al.
5,881,569 A 3/1999 Campbell et al.
5,890,377 A 4/1999 Foglietta
5,890,378 A 4/1999 Rambo et al.
5,950,453 A * 9/1999 Bowen ..... B23K 9/173 62/612
5,979,177 A 11/1999 Sumner et al.
5,983,664 A 11/1999 Campbell et al.
5,983,665 A 11/1999 Howard et al.
5,992,175 A 11/1999 Yao et al.
6,003,603 A 12/1999 Breivik et al.
6,021,647 A 2/2000 Ameringer et al.
6,023,942 A 2/2000 Thomas et al.
6,035,651 A 3/2000 Carey
6,053,008 A 4/2000 Arman et al.
6,070,430 A 6/2000 McNeil
6,085,546 A 7/2000 Johnston
6,105,390 A 8/2000 Bingham et al.
6,112,550 A 9/2000 Bonaquist et al.
6,182,469 B1 2/2001 Campbell et al.
6,260,380 B1 7/2001 Arman
6,266,977 B1 7/2001 Howard et al.
6,295,833 B1 10/2001 Hoffart
6,308,531 B1 * 10/2001 Roberts et al. ..... 62/611
6,311,516 B1 11/2001 Key et al.
6,311,519 B1 11/2001 Gourbier et al.
6,330,811 B1 * 12/2001 Arman et al. ..... 62/643
6,363,728 B1 4/2002 Udischas et al.
6,367,286 B1 4/2002 Price
6,401,486 B1 6/2002 Lee et al.
6,405,561 B1 6/2002 Mortko et al.
6,412,302 B1 7/2002 Foglietta
6,425,263 B1 7/2002 Bingham et al.
6,425,266 B1 7/2002 Roberts
6,427,483 B1 8/2002 Rashad et al.
6,438,994 B1 8/2002 Rashad et al.
6,449,982 B1 9/2002 Fischer
6,449,983 B2 9/2002 Pozivil
6,460,350 B2 10/2002 Johnson et al.
6,560,989 B1 5/2003 Roberts et al.
6,578,379 B2 6/2003 Paradowski
6,581,410 B1 6/2003 Johnson et al.
6,662,589 B1 * 12/2003 Roberts et al. ..... 62/425
6,725,688 B2 4/2004 Elion
6,745,576 B1 6/2004 Granger
6,823,691 B2 11/2004 Ohta
6,823,692 B1 11/2004 Patel et al.
6,915,662 B2 7/2005 Wilkinson et al.
6,925,837 B2 8/2005 Eaton
6,945,075 B2 9/2005 Wilkinson et al.
7,051,553 B2 5/2006 Mak et al.
7,069,744 B2 7/2006 Patel et al.
7,100,399 B2 9/2006 Eaton
7,107,788 B2 9/2006 Patel et al.
7,114,342 B2 10/2006 Oldham et al.
7,152,428 B2 12/2006 Lee et al.
7,152,429 B2 12/2006 Paradowski
7,159,417 B2 1/2007 Foglietta et al.
7,191,617 B2 3/2007 Cuellar et al.
7,204,100 B2 4/2007 Wilkinson et al.
7,210,311 B2 5/2007 Wilkinson et al.
7,216,507 B2 5/2007 Cuellar
7,219,513 B1 5/2007 Mostafa
7,234,321 B2 6/2007 Maunder et al.
7,234,322 B2 6/2007 Hahn et al.
7,266,975 B2 9/2007 Hupkes
7,310,972 B2 12/2007 Yoshida et al.
7,316,127 B2 1/2008 Huebel et al.
7,357,003 B2 4/2008 Ohara et al.
7,484,385 B2 2/2009 Patel
7,614,241 B2 11/2009 Mostello
7,644,676 B2 1/2010 Lee et al.
7,713,497 B2 5/2010 Mak
7,793,517 B2 9/2010 Patel et al.
7,818,979 B2 10/2010 Patel et al.
7,841,288 B2 11/2010 Lee et al.
7,856,847 B2 12/2010 Patel et al.
8,505,312 B2 8/2013 Mak et al.
8,549,876 B2 10/2013 Kaart et al.
8,650,906 B2 2/2014 Price et al.
8,671,699 B2 3/2014 Rosetta et al.
2002/0124595 A1 * 9/2002 Howard ..... C01B 3/506 62/622
2002/0166336 A1 11/2002 Wilkinson et al.
2003/0029190 A1 2/2003 Trebble
2003/0046953 A1 3/2003 Elion et al.
2004/0159122 A1 8/2004 Patel et al.
2004/0255616 A1 * 12/2004 Maunder et al. ..... 62/611
2005/0056051 A1 * 3/2005 Roberts et al. ..... 62/612
2005/0204625 A1 9/2005 Briscoe et al.
2005/0229634 A1 * 10/2005 Huebel ..... C07C 7/09 62/632
2006/0260355 A1 * 11/2006 Roberts ..... F25J 1/0022 62/620
2006/0260358 A1 11/2006 Kun
2007/0157663 A1 * 7/2007 Mak et al. ..... 62/620
2007/0231244 A1 10/2007 Shah et al.
2008/0016910 A1 * 1/2008 Brostow ..... F25J 1/0022 62/630
2008/0264076 A1 10/2008 Price
2009/0193846 A1 8/2009 Foral et al.
2009/0205367 A1 8/2009 Price
2009/0217701 A1 * 9/2009 Minta et al. ..... 62/612
2010/0043488 A1 2/2010 Mak et al.
2010/0064725 A1 3/2010 Chieng et al.
2010/0132405 A1 6/2010 Nilsen
2010/0263407 A1 * 10/2010 Paradowski et al. ..... 62/621
2011/0289963 A1 12/2011 Price
2012/0000245 A1 1/2012 Currence et al.
2012/0090324 A1 4/2012 Rosetta et al.

(56) References Cited

U.S. PATENT DOCUMENTS

| | | | |
|---|---|---|---|
| 2012/0137726 | A1 | 6/2012 | Currence et al. |
| 2013/0213807 | A1 | 8/2013 | Hanko et al. |

FOREIGN PATENT DOCUMENTS

| | | |
|---|---|---|
| JP | 2003232226 | 8/2003 |
| WO | 2005045338 | 5/2005 |

OTHER PUBLICATIONS

Gas Processors Suppliers Association (GPSA) Engineering Databook, Section 16 "Hydrocarbon Recovery," p. 16-13 through 16-20, 12th ed. (2004).

* cited by examiner

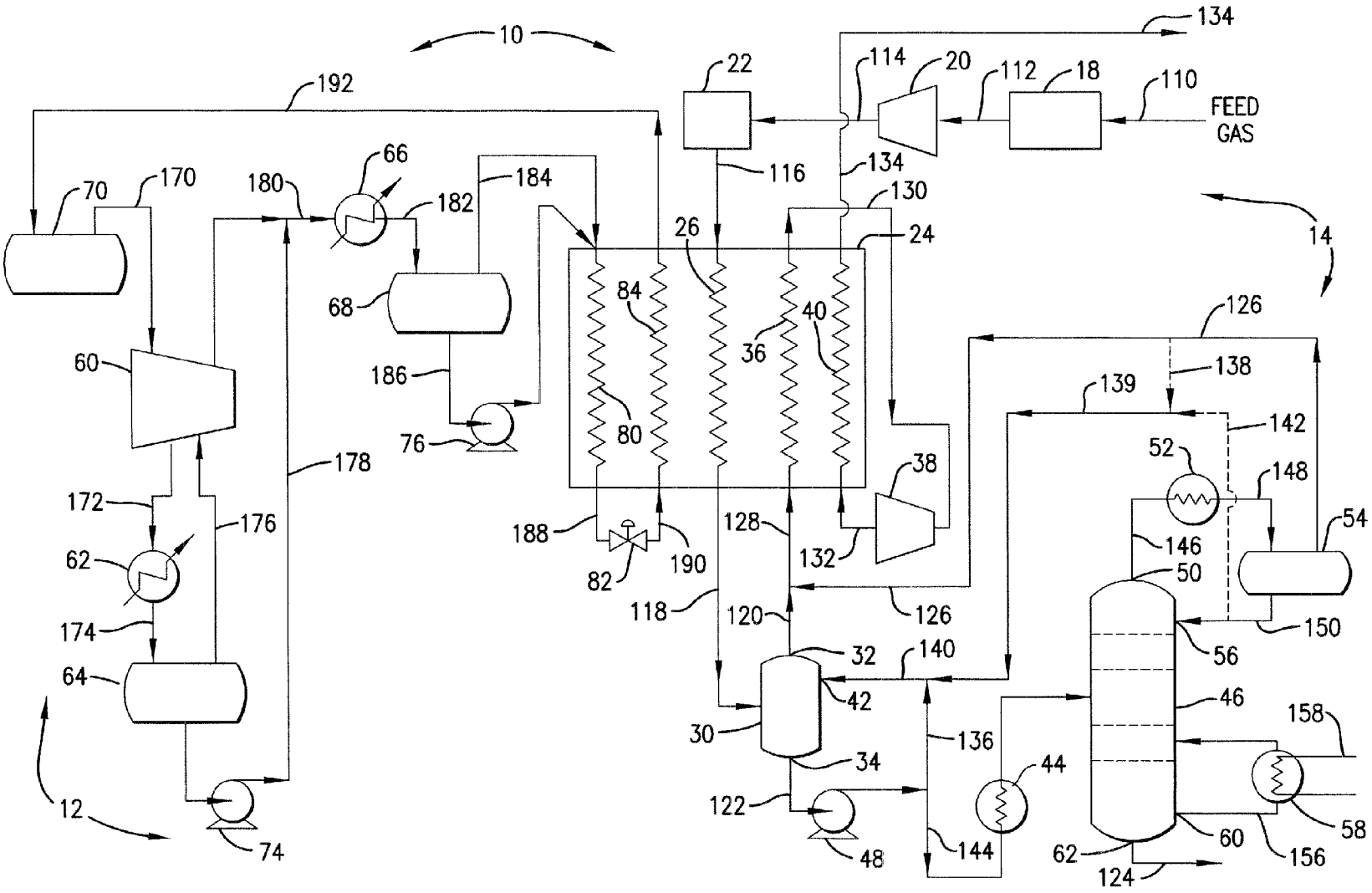
FEED GAS
10
12
14
18
20
22
24
26
30
32
34
36
38
40
42
44
46
48
50
52
54
56
58
60
62
64
66
68
70
74
76
80
82
84
110
112
114
116
118
120
122
124
126
128
130
132
134
136
138
139
140
142
144
146
148
150
156
158
170
172
174
176
178
180
182
184
186
188
190
192

NGL RECOVERY FROM NATURAL GAS USING A MIXED REFRIGERANT

CROSS-REFERENCE TO RELATED APPLICATIONS

This application claims priority under 35 U.S.C. §119(e) from U.S. Provisional Patent Application No. 61/418,444, filed Dec. 1, 2010, the entirely of which is incorporated herein by reference.

BACKGROUND

1. Technical Field

One or more embodiments of the invention generally relate to systems and processes for recovering natural gas liquids (NGL) from a gas stream using a closed-loop mixed refrigerant cycle.

2. Description of Related Art

In recent years, higher energy prices have prompted oil and gas producers to utilize heavier hydrocarbon materials as feedstocks to produce fuels and other end products. In doing so, general reliance on "cracking" processes that break long-chain, high carbon number molecules to smaller, more utilizable hydrocarbons, has increased. As a result, more off-gas streams from these cracking processes are produced that comprise higher concentrations of hydrogen and olefins, which may be desirable to recover for subsequent use. In particular, the recovery of $C_2$ through $C_6$ olefins is increasingly desirable in order to provide valuable feedstocks for the petrochemical industry.

Conventional processes for separating ethylene and heavier components (e.g., $C_2$+ components) from a gas stream currently are plagued by a variety of drawbacks. For example, many C2+ recovery processes must be carried out at very low temperatures (e.g., less than −180° F.) and/or high pressures (e.g., above 600 psig). As a result, these processes are capital intensive and expensive to operate and maintain. In addition, the severe operating conditions required by conventionally-designed systems can result in formation and accumulation of unique byproducts, such as "blue oil," that are both highly undesirable and potentially hazardous.

Thus, a need exists for a process and systems for recovering natural gas liquids (NGL) from a feed gas stream that minimize compression requirements and byproduct formation, while maximizing recovery of valuable products. The system should be both robust and operationally flexible to handle variations in both feed gas composition and flow rate, and should be simple and cost-efficient to operate and maintain.

SUMMARY

One embodiment of the present invention concerns a process for recovering natural gas liquids (NGL) from a feed gas stream. The process comprises cooling and at least partially condensing the feed gas stream via indirect heat exchange with a mixed refrigerant stream to thereby provide a cooled feed gas stream. The process also comprises separating the cooled feed gas stream into a first residue gas stream enriched in methane and lighter components and a first liquid product stream enriched in $C_2$ and heavier components in a first vapor-liquid separation vessel while at relatively high pressure. Further, the process comprises separating the first liquid product stream into a second residue gas stream and a second liquid product stream in a second vapor-liquid separation vessel. The process also comprises recovering at least a portion of the second liquid product stream as an NGL product stream.

Another embodiment of the present invention concerns a process for recovering natural gas liquids (NGL) from a hydrocarbon-containing feed gas stream. The process comprises compressing a mixed refrigerant stream with a refrigeration compressor to thereby provide a compressed mixed refrigerant stream having a pressure less than 550 psig and cooling the compressed mixed refrigerant stream in a first heat exchanger to thereby provide a cooled mixed refrigerant stream. The process also comprises passing the cooled mixed refrigerant stream through an expansion device to thereby provide an expanded refrigerant stream. The process further comprises cooling the hydrocarbon-containing feed gas stream via indirect heat exchange with the expanded refrigerant stream to thereby provide a cooled feed gas stream and separating the cooled feed gas stream into a first residue gas stream and a first liquid product stream. The process also comprises recovering an NGL product stream from at least a portion of the first liquid product stream. During the above-listed steps, the temperatures of the compressed mixed refrigerant stream, the cooled mixed refrigerant stream, and the expanded refrigerant stream are sufficient to condense at least a portion of the $C_2$ and heavier components or at least a portion of the $C_3$ and heavier components originally present in said hydrocarbon-containing feed stream.

Yet another embodiment of the present invention concerns a natural gas liquids (NGL) recovery facility for recovering $C_2$ and heavier components from a hydrocarbon-containing feed gas stream using a single closed-loop mixed refrigeration cycle. The facility comprises a feed gas compressor, a primary heat exchanger, a first vapor-liquid separation vessel, and a second vapor-liquid separation vessel. The feed gas compressor defines a feed suction port and a feed discharge port. The feed gas compressor is operable to compress a hydrocarbon-containing feed gas stream to a suitable pressure, typically not more than 600 psig. The primary heat exchanger defines a first cooling pass for cooling the compressed feed gas stream and the first vapor-liquid separation vessel defines a first fluid inlet coupled in fluid flow communication with the first cooling pass. The first vapor-liquid separation vessel further defines a first upper vapor outlet and a first lower liquid outlet and is operable to separate the cooled feed gas stream into a first residue gas stream withdrawn via the first upper vapor outlet and a first liquid stream withdrawn via first lower liquid outlet. The second vapor-liquid separation vessel defines a second fluid inlet coupled in fluid flow communication with the first lower liquid outlet of the first vapor-liquid separation vessel, a second upper vapor outlet, and a second lower liquid outlet. The second-vapor liquid separation vessel is operable to separate the first liquid stream from the first vapor-liquid separation vessel into a second residue gas stream and an NGL product stream.

The facility also comprises a single closed-loop mixed refrigerant refrigeration cycle comprising a refrigerant compressor, a first refrigerant cooling pass, an expansion device, and a first refrigerant warming pass. The refrigerant compressor defines a suction inlet and a discharge outlet and is operable to compress a stream of mixed refrigerant. The first refrigerant cooling pass is in fluid flow communication with the discharge outlet of the refrigerant compressor and is disposed in the primary heat exchanger. The first refrigerant cooling pass is operable to cool at least a portion of the compressed stream of mixed refrigerant. The expansion device defines a high pressure inlet and a low pressure outlet and is operable to expand the cooled mixed refrigerant stream. The high pressure inlet is coupled in fluid flow communication with the first refrigerant cooling pass. The first refrigerant warming pass is disposed within the primary heat exchanger and is operable to warm the expanded mixed refrigerant stream via indirect heat exchange with the compressed mixed refrigerant stream in the first refrigerant cooling pass and/or the compressed feed gas stream in the first cooling pass. The first refrigerant warming pass is coupled in fluid flow communication with the low pressure outlet of the expansion device and is coupled in fluid flow communication with the suction inlet of the refrigerant compressor.

BRIEF DESCRIPTION OF THE DRAWINGS

Various embodiments of the present invention are described in detail below with reference to the attached drawing FIGURE, wherein:

FIG. 1 provides a schematic depiction of a natural gas liquids (NGL) recovery facility configured according to one embodiment of the present invention, particularly illustrating the use of a single closed-loop mixed refrigerant system to recover natural gas liquids from an incoming feed gas stream.

DETAILED DESCRIPTION

Turning now to FIG. 1, a schematic depiction of a natural gas liquids (NGL) recovery facility 10 configured according to one or more embodiments of the present invention is provided. As used herein, the terms "natural gas liquids" or "NGL" refer to a mixture of one or more hydrocarbon components having from 2 to 5 or more carbon atoms per molecule. In one embodiment, an NGL stream can comprise less than 25, less than 15, less than 10, or less than 5 mole percent of methane and lighter components. NGL recovery facility 10 can be operable to remove or recover a substantial portion of the total amount of natural gas liquids in the incoming gas stream by cooling the gas with a single, closed-loop refrigeration cycle 12 and separating the condensed liquids in a NGL fractionation zone 14. Various aspects of NGL recovery facility 10 will now be described in detail below, with reference to FIG. 1.

As shown in FIG. 1, a hydrocarbon-containing feed gas stream can initially be introduced into NGL recovery facility 10 via conduit 110. The feed gas stream in conduit 110 can be any suitable hydrocarbon-containing predominantly vapor stream, such as, for example, a natural gas stream, a synthesis gas stream, a cracked gas stream, or combinations thereof. The feed gas stream in conduit 110 can originate from a variety of gas sources (not shown), including, but not limited to, a petroleum production well; a refinery processing unit, such as a fluidized catalytic cracker (FCC) or petroleum coker; or a heavy oil processing unit, such as an oil sands upgrader. In one embodiment, the feed stream in conduit 110 can be a cracked gas stream originating from an FCC, a coker, or an upgrader.

In one embodiment of the present invention, the hydrocarbon-containing feed stream in conduit 110 includes $C_2$ and heavier components. As used herein, the general term "$C_x$" refers to a hydrocarbon component comprising x carbon atoms per molecule and, unless otherwise noted, is intended to include all straight-chain and olefinic isomers thereof. Thus, "$C_2$" is intended to encompass both ethane and ethylene, while "$C_5$" is intended to encompass isopentane, normal pentane, and $C_5$ olefins. As used herein, the term "$C_x$ and heavier" refers to hydrocarbons having x or more carbon atoms per molecule (including isomers and olefins), while the term "$C_x$ and lighter" refers to hydrocarbons having x or less carbon atoms per molecule (including isomers and olefins). According to one embodiment, the feed gas stream in conduit 110 can comprise at least 15, at least 20, at least 25, at least 40, at least 50, at least 65, at least 75, or at least 80 mole percent $C_2$ and heavier components, based on the total feed stream. In the same or other embodiments, the feed gas stream in conduit 110 can comprise at least 10, at least 15, at least 20, at least 25, at least 30, or at least 40 mole percent $C_3$ and heavier components, based on the total feed stream. Typically, lighter components such as methane, hydrogen, and trace amounts of gases like nitrogen and carbon dioxide, make up the balance of the composition of the feed gas stream. In one embodiment, the feed gas stream in conduit 110 comprises less than 80, less than 70, less than 60, less than 50, less than 40, less than 30, or less than 25 mole percent of methane and lighter components, based on the total stream.

As shown in FIG. 1, the gas stream in conduit 110 may initially be routed to a pretreatment zone 18, wherein one or more undesirable constituents may be removed from the feed gas prior to cooling. In one embodiment, pretreatment zone 18 can include one or more vapor-liquid separation vessels (not shown) for removing liquid water or hydrocarbon components from the feed gas. Optionally, pretreatment zone 18 can include one or more sulfur-removal zones (not shown), such as, for example, an amine unit, for removing sulfur-containing components from the feed gas stream in conduit 110.

The treated gas stream exiting pretreatment zone 18 via conduit 112 can then be routed to the suction port of a feed gas compressor 20, as shown in FIG. 1, should it be necessary to raise the pressure thereof. If the feed gas is already at sufficiently high pressure, this compression step may be omitted. Feed gas compressor 20 can be any suitable compression device for increasing the pressure of the gas stream in conduit 112 to a desirable pressure. In one embodiment, the pressure of the compressed feed gas stream in conduit 114 can be at least 250, at least 300, at least 350, at least 400 psig and/or not more than 625, not more than 550, not more than 500, not more than 450, or not more than 425 psig. This is in contrast to many conventional gas processing systems, which typically seek to recover $C_2$ and heavier components from a gas stream having a pressure of at least 600 psig and as high as 950 psig. In one embodiment, feed gas compressor 20 can be a multi-stage, optionally single body, centrifugal compressor driven by a driver such as, for example, a steam or gas turbine. In an alternative embodiment, feed gas compressor 20 can be at least partially driven by work recovered by one or more expansion devices utilized elsewhere within NGL recovery facility 10, an embodiment of which is discussed below.

After exiting the discharge outlet of feed gas compressor 20, the compressed feed stream in conduit 114 can then be routed to a dehydration unit 22, wherein at least a portion of any residual water can be removed from the gas stream. Dehydration unit 22 can utilize any known water removal system, such as, for example, beds of molecular sieve. Once dried, the pressurized gas stream in conduit 116 can have a temperature of at least 50° F., at least 60° F., at least 75° F., or at least 80° F. and/or not more than 150° F., not more than 135° F., or not more than 110° F. and a pressure of at least 250, at least 300, at least 350, at least 375 and/or not more than 600, not more than 550, not more than 500, or not more than 400 psig.

As shown in FIG. 1, the pressurized stream in conduit 116 can then be routed to a primary heat exchanger 24. Primary heat exchanger 24 can be any heat exchanger operable to cool and at least partially condense the feed gas stream in conduit 116 via indirect heat exchange with one or more cooling streams. In one embodiment, primary heat exchanger 24 can be a brazed aluminum heat exchanger comprising a plurality of cooling and warming passes (cores) for facilitating indirect heat exchange between one or more process and refrigerant streams. Because the operating conditions utilized in embodiments of the present invention are not as severe as many cryogenic or liquefaction processes, primary heat exchanger 24 can be insulated, rather than surrounded by a "cold box," as often employed in many conventional low-temperature gas processing systems.

As shown in FIG. 1, the pressurized gas stream in conduit 116 can be introduced into a cooling pass 26, wherein the stream is cooled and at least partially condensed via indirect heat exchange. Additional details regarding the refrigeration cycle 12 of NGL recovery facility 10 are discussed below. During cooling, a substantial portion of the $C_2$ and heavier and/or the $C_3$ and heavier components in the feed gas stream can be condensed out of the vapor phase within cooling pass 26. For example, in one embodiment, at least 50, at least 60, at least 70, at least 75, at least 80, or at least 85 mole percent of the total amount of $C_2$ and heavier components introduced into primary exchanger 24 via conduit 116 can be condensed within cooling pass 26, while, in the same or other embodiments, at least 50, at least 60, at least 70, at least 80, at least 90, or at least 95 mole percent of the total amount of $C_3$ and heavier components introduced into cooling pass 26 can be condensed therein. According to one embodiment, the vapor phase of the stream in conduit 118 withdrawn from cooling pass 26 can comprise at least 50, at least 60, at least 75, at least 85, or at least 90 percent of the total amount of $C_1$ and lighter components originally introduced into primary heat exchanger 24 via conduit 116.

The cooled, at least partially condensed feed stream withdrawn from primary heat exchanger 24 via conduit 118 can have a temperature of no less than −165° F., no less than −160° F., no less than −150° F., no less than −140° F., no less than −130° F., no less than −120° F., no less than −100° F., or no less than −80° F., which is substantially warmer than the −170° F. to −200° F. temperature achieved in many conventional cryogenic facilities.

As shown in one embodiment depicted in FIG. 1, the cooled, preferably two-phase stream in conduit 118 can be introduced into a separation vessel 30, wherein the vapor and liquid phases of the stream can be separated into a predominantly vapor stream exiting separation vessel 30 via an upper vapor outlet 32 and a predominantly liquid stream exiting separation vessel 30 via a lower liquid outlet 34. As used herein, the terms "predominantly," "primarily," and "majority" mean greater than 50 percent. Separation vessel 30 can be any suitable vapor-liquid separation vessel and can have any number of theoretical separation stages. In one embodiment, separation vessel 30 can comprise a single separation stage, while in other embodiments, separation vessel 30 can include at least 2, at least 4, at least 6, and/or not more than 30, not more than 20, or not more than 10 theoretical separation stages. When separation vessel 30 is a multistage separation vessel, any suitable type of column internals, such as mist eliminators, mesh pads, vapor-liquid contacting trays, random packing, and/or structured packing, can be used to facilitate heat and/or mass transfer between the vapor and liquid streams.

The overhead vapor stream in conduit 120 withdrawn via upper vapor outlet 32 of separation vessel 30 can be enriched in methane and lighter components. As used herein, the term "enriched in" means comprising at least 50 mole percent of one or more specific components. In one embodiment, the overhead vapor or residue gas stream in conduit 120 can comprise at least 50, at least 60, at least 75, or at least 85 mole percent of methane and lighter components, such as, for example, hydrogen and/or nitrogen. According to one embodiment, the residue gas stream in conduit 120 can comprise at least 80, at least 85, at least 90, or at least 95 percent of the total amount of $C_1$ and lighter components introduced into primary heat exchanger 24 via conduit 116. As shown in FIG. 1, the residue gas stream in conduit 120 can be combined with a yet-to-be-discussed gas stream in conduit 126 and the combined stream in conduit 128 can be introduced into a warming pass 36 of primary heat exchanger 24. As the combined vapor stream passes through warming pass 36, it can be heated via indirect heat exchange with a yet-to-be-discussed refrigerant stream and/or the feed gas stream in cooling pass 26. The resulting warmed vapor stream in conduit 130 can be optionally expanded via expansion device 38 (illustrated herein as turboexpander 38) before being re-routed via conduit 132 to a further warming pass 40 of primary heat exchanger 24. As previously mentioned, in one embodiment, at least a portion of the work recovered by expansion device 38 can be used to drive feed gas compressor 20.

As shown in FIG. 1, the warmed stream can then be routed from NGL recovery facility 10 via conduit 134 to one or more downstream units for subsequent processing, storage, and/or use. In some embodiments (not shown), the residue gas stream in conduit 120 can pass directly through a single warming pass (not shown), thereby bypassing expansion device 38 and further warming pass 40. Depending on the required pressure for this stream, it may be preferable to avoid the optional expansion described above and combine warming pass 36 and warming pass 40. In one embodiment, the residue gas product stream in conduit 134, which comprises at least 50, at least 60, at least 70, or at least 80 mole percent of the $C_1$ and lighter components originally present in the feed stream in conduit 110, can have a vapor fraction of at least 0.85, at least 0.90, at least 0.95, or can be substantially all vapor.

As previously mentioned, a liquid product stream enriched in $C_2$ and heavier components can be withdrawn from lower liquid outlet 34 of separation vessel 30 via conduit 122, as shown in FIG. 1. In one embodiment wherein separation vessel 30 comprises an absorber column, a portion of the liquid stream in conduit 122 withdrawn via conduit 136 can be pumped via pump 48 to a reflux/absorber liquid inlet 42 located in the upper region of separation vessel 30. In some embodiments, the recirculated absorber liquid stream in conduit 136 can optionally be combined with a yet-to-be-discussed stream in conduit 139 and the combined stream can be introduced into separation vessel 30 via conduit 140, as shown in FIG. 1. In the same or another embodiment, a portion of the liquid stream in conduit 122 can be heated and at least partially vaporized in a reboiler (not shown) and the resulting two-phase stream can be reintroduced into the lower portion of separation vessel 30 via a reboiler return (not shown).

The remaining liquid in conduit 144 can be heated via indirect heat exchange with a heat transfer medium in a heat exchanger 44. Although depicted generally in FIG. 1 as comprising a stand-alone heat exchanger 44, in some embodiments, heat exchanger 44 can comprise a warming pass disposed within primary heat exchanger 24 (embodiment not shown in FIG. 1) operable to warm the liquid stream in conduit 144 via indirect heat exchange with one or more other process or refrigerant streams. The resulting warmed liquid stream in conduit 144 can have a temperature of at least −80° F., −65° F., or −50° F., and can be introduced into a second separation vessel 46, as shown in FIG. 1.

Separation vessel 46 can be any vessel capable of further separating $C_2$ and heavier or $C_3$ and heavier components from the remaining $C_1$ and lighter or $C_2$ and lighter components. In one embodiment, separation vessel 46 can be a multi-stage distillation column comprising at least 2, at least 4, at least 6, at least 8 and/or not more than 50, not more than 35, or not more than 20 theoretical separation stages. When separation column 46 comprises a multi-stage distillation column, one or more types of column internals may be utilized in order to facilitate heat and/or mass transfer between the vapor and liquid phases. Examples of suitable column internals can include, but are not limited to, vapor-liquid contacting trays, structured packing, random packing, and any combination thereof. According to one embodiment, separation vessel 46 can be operable to separate at least 65, at least 75, at least 85, at least 90, or at least 99 percent of the remaining $C_2$ and heavier and/or $C_3$ and heavier components from the fluid stream introduced into separation vessel 46 via conduit 144. According to one embodiment, the overhead (top) pressure of separation vessel 30 and separation vessel 46 can be substantially the same. For example, the overhead pressures of separation vessels 30 and 46 can be within less than 100 psi, within less than 75 psi, within less than 50 psi, or within less than 25 psi of one another.

As shown in FIG. 1, the overhead vapor stream withdrawn from upper vapor outlet 50 of separation vessel 46 via conduit 146 can be routed to an overhead condenser 52, wherein the overhead stream can be cooled and at least partially condensed via indirect heat exchange with a cooling medium. Although depicted as a "stand alone" exchanger in FIG. 1, in some embodiments, the overhead stream withdrawn from separator 46 can be condensed via indirect heat exchange with a refrigerant stream from refrigeration cycle 12. When a stream of refrigerant from refrigeration cycle 12 is used as the cooling medium for the overhead stream in conduit 146, the overhead vapor cooling pass (not shown) can be located within primary heat exchanger 24 or within a secondary heat exchanger structure or shell (not shown).

In one embodiment, the resulting cooled stream in conduit 148 can be routed to a overhead accumulator 54, wherein the vapor and liquid phases can be separated. As shown in FIG. 1, the liquid portion withdrawn from accumulator 54 can be routed via conduit 150 to a reflux inlet 56 of separation vessel 46, wherein the stream can be used as reflux to facilitate recovery of the $C_2$ and heavier and/or $C_3$ and heavier components. As shown in FIG. 1, the vapor stream withdrawn from accumulator 54 via conduit 126 can be combined with the overhead residue gas stream withdrawn from separation vessel 30 via conduit 120 and the combined stream in conduit 128 can be heated, expanded, and further heated before being removed from NGL recovery facility 10, as discussed in detail previously. In one embodiment, a portion of the vapor stream in conduit 126 can be withdrawn via conduit 138 and can then be combined with the liquid product slip-stream withdrawn from separator 30 via conduit 136. As shown in FIG. 1, the combined stream in conduit 140 can then be introduced into separator 30 as an absorber liquid/reflux stream, as discussed previously. Further, in the same or another embodiment, a portion of the liquid stream withdrawn from overhead accumulator 54 via conduit 150 can optionally be combined with the stream in conduit 138 before being introduced into separator 30 via conduit 140, as illustrated by optional conduit 142 in FIG. 1.

As shown in FIG. 1, separation vessel 46 can optionally include at least one reboiler 58 for heating and at least partially vaporizing a liquid stream withdrawn from separation vessel 46 via a reboiler supply 60 in conduit 156 through indirect heat exchange with a warming fluid stream in conduit 158. In one embodiment, the warming stream in conduit 158 can comprise at least a portion of the feed gas stream withdrawn from or within conduits 110, 112, 114, or 116. In another embodiment, the warming stream in conduit 158 can comprise steam or other warmed heat transfer medium. Although generally illustrated as including a single reboiler 58, it should be understood that any suitable number of reboilers can be employed in order to maintain the desired temperature profile within separation vessel 46.

According to one embodiment, the liquid stream withdrawn from lower liquid outlet 62 of separation vessel 46 via conduit 124 can be enriched in $C_2$ and heavier or $C_3$ and heavier components. In another embodiment, the NGL product stream recovered in conduit 124 can comprise at least 75, at least 80, at least 85, at least 90, or at least 95 mole percent of $C_2$ and heavier or $C_3$ and heavier components. Correspondingly, the NGL product stream can comprise less than 25, less than 20, less than 15, less than 10, or less than 5 mole percent of $C_1$ and lighter or $C_2$ and lighter components, depending on the operation of NGL recovery facility 10. Further, in one embodiment, the NGL product stream in conduit 124 can comprise at least 50, at least 65, at least 75, at least 85, at least 90, at least 95, at least 97, or at least 99 percent of all the $C_2$ and heavier or $C_3$ and heavier components originally introduced into primary exchanger 24 via conduit 116. That is, in some embodiments, processes and systems of the present invention can have a $C_2$+ or $C_3$+ recovery of at least 50, at least 65, at least 75, at least 85, at least 90, at least 95, at least 97, or at least 99 percent. In one embodiment, the NGL product stream in conduit 124 can subsequently be routed to a fractionation zone (not shown) comprising one or more additional separation vessels or columns, wherein individual product streams enriched in $C_2$, $C_3$, $C_4$ and heavier, or other components can be produced for subsequent use, storage, and/or further processing.

Turning now to refrigeration cycle 12 of NGL recovery facility 10 depicted in FIG. 1, closed-loop refrigeration cycle 12 is illustrated as generally comprising a refrigerant compressor 60, an optional interstage cooler 62 and interstage accumulator 64, a refrigerant condenser 66, a refrigerant accumulator 68, and a refrigerant suction drum 70. As shown in FIG. 1, a mixed refrigerant stream withdrawn from suction drum 70 via conduit 170 can be routed to a suction inlet of refrigerant compressor 60, wherein the pressure of the refrigerant stream can be increased. When refrigerant compressor 60 comprises a multistage compressor having two or more compression stages, as shown in FIG. 1, a partially compressed refrigerant stream exiting the first (low pressure) stage of compressor 60 can be routed via conduit 172 to interstage cooler 62, wherein the stream can be cooled and at least partially condensed via indirect heat exchange with a cooling medium (e.g., cooling water or air).

The resulting two-phase stream in conduit 174 can be introduced into interstage accumulator 64, wherein the vapor and liquid portions can be separated. A vapor stream withdrawn from accumulator 64 via conduit 176 can be routed to the inlet of the second (high pressure) stage of refrigerant compressor 60, wherein the stream can be further compressed. The resulting compressed refrigerant vapor stream, which can have a pressure of at least 100, at least 150, or at least 200 psig and/or not more than 550, not more than 500, not more than 450, or not more than 400 psig, can be recombined with a portion of the liquid phase refrigerant withdrawn from interstage accumulator 64 via conduit 178 and pumped to pressure via refrigerant pump 74, as shown in FIG. 1.

The combined refrigerant stream in conduit 180 can then be routed to refrigerant condenser 66, wherein the pressurized refrigerant stream can be cooled and at least partially condensed via indirect heat exchange with a cooling medium (e.g., cooling water) before being introduced into refrigerant accumulator 68 via conduit 182. As shown in FIG. 1, the vapor and liquid portions of the two-phase refrigerant stream in conduit 182 can be separated and separately withdrawn from refrigerant accumulator 68 via respective conduits 184 and 186. Optionally, a portion of the liquid stream in conduit 186, pressurized via refrigerant pump 76, can be combined with the vapor stream in conduit 184 just prior to or within a refrigerant cooling pass 80 disposed within primary exchanger 24, as shown in FIG. 1. In one embodiment, re-combining a portion of the vapor and liquid portions of the compressed refrigerant in this manner may help ensure proper fluid distribution within refrigerant cooling pass 80.

As the compressed refrigerant stream flows through refrigerant cooling pass 80, the stream is condensed and sub-cooled, such that the temperature of the liquid refrigerant stream withdrawn from primary heat exchanger 224 via conduit 188 is well below the bubble point of the refrigerant mixture. The sub-cooled refrigerant stream in conduit 188 can then be expanded via passage through an expansion device 82 (illustrated herein as Joule-Thompson valve 82), wherein the pressure of the stream can be reduced, thereby cooling and at least partially vaporizing the refrigerant stream. The cooled, two-phase refrigerant stream in conduit 190 can then be routed through a refrigerant warming pass 84, wherein a substantial portion of the refrigeration generated via the expansion of the refrigerant can be recovered as cooling for one or more process streams, including the feed stream flowing through cooling pass 26, as discussed in detail previously. The warmed refrigerant stream withdrawn from primary heat exchanger 24 via conduit 192 can then be routed to refrigerant suction drum 70 before being compressed and recycled through closed-loop refrigeration cycle 12 as previously discussed.

According to one embodiment of the present invention, during each step of the above-discussed refrigeration cycle, the temperature of the refrigerant can be maintained such that at least a portion, or a substantial portion, of the $C_2$ and heavier components or the $C_3$ and heavier components originally present in the feed gas stream can be condensed in primary exchanger 24. For example, in one embodiment, at least 50, at least 65, at least 75, at least 80, at least 85, at least 90, or at least 95 percent of the total $C_2$+ components or at least 50, at least 65, at least 75, at least 80, at least 85, at least 90, or at least 95 percent of the total $C_3$+ components originally present in the feed gas stream introduced into primary exchanger 24 can be condensed. In the same or another embodiment, the minimum temperature achieved by the refrigerant during each step of the above-discussed refrigeration cycle can be no less than −175° F., no less than −170° F., no less than −165° F., no less than −160° F., no less than −150° F., not less than −145° F., not less than −140° F., or not less than −135° F. This, too, is in contrast to conventional mixed refrigeration cycles utilized to cool gas streams, which often include one or more cooling steps carried out at temperatures much lower than −175° F. In some embodiments, operating refrigeration cycle 12 at warmer temperatures may decrease the formation of one or more undesirable by-products within the feed gas stream, such as, for example nitrogen oxide gums (e.g., $NO_x$ gums) which can form at temperatures below about −150° F. According to embodiments of the present invention, formation of such byproducts can be minimized or nearly eliminated.

In one embodiment, the refrigerant utilized in closed-loop refrigeration cycle 12 can be a mixed refrigerant. As used herein, the term "mixed refrigerant" refers to a refrigerant composition comprising two or more constituents. In one embodiment, the mixed refrigerant utilized by refrigeration cycle 12 can comprise two or more constituents selected from the group consisting of methane, ethylene, ethane, propylene, propane, isobutane, n-butane, isopentane, n-pentane, and combinations thereof. In some embodiments, the refrigerant composition can comprise methane, ethane, propane, normal butane, and isopentane and can substantially exclude certain components, including, for example, nitrogen or halogenated hydrocarbons. According to one embodiment, the refrigerant composition can have an initial boiling point of at least −120° F., at least −130° F., or at least −135° F. and/or not more than −100° F., −105° F., or −110° F. Various specific refrigerant compositions are contemplated according to embodiments of the present invention. Table 1, below, summarizes broad, intermediate, and narrow ranges for several exemplary refrigerant mixtures.

TABLE 1

Exemplary Mixed Refrigerant Compositions

| Component | Broad Range, mole % | Intermediate Range, mole % | Narrow Range, mole % |
|---|---|---|---|
| methane | 0 to 50 | 5 to 40 | 10 to 30 |
| ethylene | 0 to 50 | 5 to 40 | 10 to 30 |
| ethane | 0 to 50 | 5 to 40 | 10 to 30 |
| propylene | 0 to 50 | 5 to 40 | 5 to 30 |
| propane | 0 to 50 | 5 to 40 | 5 to 30 |
| i-butane | 0 to 10 | 0 to 5 | 0 to 2 |
| n-butane | 0 to 25 | 1 to 20 | 5 to 15 |
| i-pentane | 0 to 30 | 1 to 20 | 2 to 15 |
| n-pentane | 0 to 10 | 0 to 5 | 0 to 2 |

In some embodiments of the present invention, it may be desirable to adjust the composition of the mixed refrigerant to thereby alter its cooling curve and, therefore, its refrigeration potential. Such a modification may be utilized to accommodate, for example, changes in composition and/or flow rate of the feed gas stream introduced into NGL recovery facility 10. In one embodiment, the composition of the mixed refrigerant can be adjusted such that the heating curve of the vaporizing refrigerant more closely matches the cooling curve of the feed gas stream. One method for such curve matching is described in detail, with respect to an LNG facility, in U.S. Pat. No. 4,033,735, the disclosure of which is incorporated herein by reference in a manner consistent with the present disclosure.

According to one embodiment of the present invention, such a modification of the refrigeration composition may be desirable in order to alter the proportion or amount of specific components recovered in the NGL product stream. For example, in one embodiment, it may be desirable to recover $C_2$ components in the NGL product stream (e.g., $C_2$ recovery mode), while, in another embodiment, rejecting $C_2$ components in the overhead residue gas withdrawn from separation vessel 56 may be preferred (e.g., $C_2$ rejection mode). In addition to altering the composition of the mixed refrigerant, the transition between a $C_2$ recovery mode and a $C_2$ rejection mode may be affected by, for example, altering the operation of separation vessel 30 and/or separation vessel 46. For example, in one embodiment, at least a portion of the condensed liquid overhead in conduit 150 and/or the flashed vapor overhead in conduit 138 can be combined with the absorber liquid introduced into separation vessel 30 via conduit 140. In the same or other embodiments, the temperature and/or pressure of separation column 46 can be adjusted to vaporize more $C_2$ components, thereby minimizing $C_2$ recovery in the liquid bottoms stream.

When operating separation vessel 46 in a $C_2$ recovery mode, the NGL product stream in conduit 124 can comprise at least 50, at least 65, at least 75, at least 85, or at least 90 percent of the total $C_2$ components introduced into primary heat exchanger 24 via conduit 116 and/or the residue gas stream in conduit 146 can comprise less than 50, less than 35, less than 25, less than 15, or less than 10 percent of the total $C_2$ components introduced into primary heat exchanger 24 via conduit 116. When operating separation vessel 46 in a $C_2$ rejection mode, the NGL product stream in conduit 124 can comprise less than 50, less than 40, less than 30, less than 20, less than 15, less than 10, or less than 5 percent of the total amount of $C_2$ components introduced into primary heat exchanger 24 via conduit 116 and/or the residue gas stream in conduit 146 can comprise at least 50, at least 60, at least 70, at least 80, at least 85, at least 90, or at least 95 percent of the total amount of $C_2$ components introduced into primary heat exchanger 24 via conduit 116. In general, the decision to operate in $C_2$ rejection and/or $C_2$ recovery mode can be influenced, in part, on the economic value of the NGL constituents and/or on the desired end use for the residue gas and NGL product streams.

The preferred forms of the invention described above are to be used as illustration only, and should not be used in a limiting sense to interpret the scope of the present invention. Obvious modifications to the exemplary one embodiment, set forth above, could be readily made by those skilled in the art without departing from the spirit of the present invention. The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for recovering a natural gas liquids (NGL) stream from a feed gas stream, said process comprising:

(a) cooling and at least partially condensing said feed gas stream from which said NGL stream is to be recovered via indirect heat exchange with a mixed refrigerant stream in a primary heat exchanger of a single, closed-loop mixed refrigeration cycle to thereby provide a cooled feed gas stream, all constituents of said NGL stream being contained within said feed gas stream;

(b) introducing the entire cooled feed gas stream into a first vapor-liquid separation vessel;

(c) separating said cooled feed gas stream introduced into said first vapor-liquid separation vessel into a first residue gas stream enriched in methane and lighter components and a first liquid product stream enriched in $C_2$ and heavier components and withdrawing each of said first residue gas stream and said first liquid product stream from said first vapor-liquid separation vessel;

(d) dividing said first liquid product stream into a first liquid portion and a second liquid portion each having the same composition as said first liquid product stream;

(e) introducing said second liquid portion into a second vapor-liquid separation vessel;

(f) separating said second liquid portion into a second residue gas stream and a second liquid product stream in said second vapor-liquid separation vessel and withdrawing each of said second residue gas stream and said second liquid product stream from said second vapor-liquid separation vessel;

(g) condensing said second residue gas steam that is withdrawn from said second vapor-liquid separation vessel to form a two-phase fluid stream;

(h) separating said two-phase fluid stream in a third vapor-liquid separator to form a liquid reflux stream and a second residue gas vapor stream and combining at least a portion of said liquid reflux stream with said first liquid portion to provide a combined liquid stream;

(i) introducing said combined liquid stream into an upper portion of said first vapor-liquid separation vessel;

(j) recovering at least a portion of said second liquid product stream withdrawn from said second vapor-liquid separation vessel in step (h) as said NGL stream;

(k) combining the entire first residue gas stream and at least a portion of said second residue gas vapor stream withdrawn from said third vapor-liquid separation vessel to form a combined residue gas stream that comprises said entire first residue gas stream and said at least a portion of said second residue gas vapor stream withdrawn from said third vapor-liquid separation vessel; and (l) heating said combined residue gas stream to thereby provide a heated residue gas stream, wherein at least a portion of said heating is carried out in said primary heat exchanger to provide at least a portion of said cooling of step (a).

2. The process of claim 1, wherein said feed gas stream has a pressure less than 600 psig prior to said cooling of step (a).

3. The process of claim 1, wherein said cooled feed gas stream has a temperature of no less than −165° F. prior to said separating of step (c).

4. The process of claim 1, wherein the temperature of said mixed refrigerant stream has a temperature of not less than −175° F. prior to said cooling of step (a).

5. The process of claim 1, further comprising, compressing a stream of mixed refrigerant to thereby provide a compressed mixed refrigerant stream; cooling said compressed mixed refrigerant stream to thereby provide a cooled mixed refrigerant stream; and expanding said cooled mixed refrigerant stream to thereby provide an expanded mixed refrigerant stream, wherein said mixed refrigerant stream utilized to perform said cooling of step (a) comprises at least a portion of said expanded mixed refrigerant stream.

6. The process of claim 5, wherein the pressure of said compressed mixed refrigerant stream is no more than 550 psig.

7. The process of claim 1, further comprising expanding at least a portion of said heated residue gas stream to thereby provide an expanded heated residue gas stream and further heating said expanded heated residue gas stream to provide a further heated residue gas stream.

8. The process of claim 7, wherein said first residue gas stream comprises at least about 80 percent of the total amount of methane and lighter components originally present in said feed gas stream prior to said cooling of step (a) and wherein said further heated residue gas stream has a vapor fraction greater than 0.85.

9. The process of claim 1, wherein said NGL stream comprises at least 80 percent of the total amount of $C_3$ and heavier components originally present in said feed gas stream prior to said cooling of step (a) and wherein said NGL stream comprises less than 20 mole percent of $C_2$ and lighter components.

10. The process of claim 1, wherein said NGL stream comprises at least 50 percent of the total amount of $C_2$ and heavier components originally present in said feed gas stream prior to said cooling of step (a).

11. The process of claim 1, wherein said mixed refrigerant comprises two or more components selected from the group consisting of methane, ethylene, ethane, propylene, propane, isobutane, n-butane, isopentane, and n-pentane.

12. The process of claim 1, wherein said recovering of step (j) comprises subjecting said NGL stream to further fractionation in one or more distillation columns to thereby produce one or more additional product streams enriched in $C_2$, $C_3$, and/or $C_4$ and heavier components.

13. A natural gas liquids (NGL) recovery facility for recovering a stream of ethane and heavier components from a hydrocarbon-containing feed gas stream using a single closed-loop mixed refrigeration cycle, said facility comprising:

a feed gas compressor defining a feed suction port and a feed discharge port, said feed gas compressor compressing said hydrocarbon-containing feed gas stream and delivering a compressed feed gas stream at a pressure of not more than 600 prig;

a primary heat exchanger defining a first cooling pass, through which the compressed feed gas stream is directed, wherein said first cooling pass cools the compressed feed gas stream to provide a cooled feed gas stream that includes all constituents of said stream of ethane and heavier components;

a first vapor-liquid separation vessel defining a first fluid inlet, a first upper vapor outlet, and a first lower liquid outlet, wherein said first fluid inlet is coupled in fluid flow communication with said first cooling pass, wherein said first vapor-liquid separation vessel separates the entire cooled feed gas stream into a first residue gas stream withdrawn via said first upper vapor outlet and a first liquid stream withdrawn via said first lower liquid outlet;

a dividing conduit to divide said first liquid stream withdrawn from said first vapor-liquid separation vessel into a first liquid portion and a second liquid portion each having the same composition as said first liquid stream;

a second vapor-liquid separation vessel defining a second fluid inlet, a second upper vapor outlet, and a second lower liquid outlet, wherein said second fluid inlet is coupled in fluid flow communication with said dividing conduit and receives said second liquid portion of said first liquid stream, wherein said second-vapor liquid separation vessel separates said second liquid portion of said first liquid stream withdrawn from said first vapor-liquid separation vessel into a second residue gas stream withdrawn via said second upper vapor outlet and an NGL stream withdrawn via said second lower liquid outlet;

a condenser having an inlet and an outlet, wherein said condenser is configured to cool and partially condense said second residue gas stream withdrawn from said second upper vapor outlet of said second vapor-liquid separation vessel;

a third vapor-liquid separation vessel having an inlet, a vapor outlet, and a liquid outlet, wherein said third vapor-liquid separation vessel is configured to separate the partially condensed second residue gas stream to form a liquid reflux stream and a second residue gas vapor stream, wherein said condenser outlet is coupled in fluid flow communication with said inlet of said third vapor-liquid separation vessel, wherein said first vapor-liquid separation vessel further defines an upper absorber liquid inlet, wherein said upper absorber liquid inlet is coupled in fluid flow communication with a combined liquid stream conduit configured to transport a combined liquid stream into an upper portion of said first vapor-liquid separation vessel, wherein said combined liquid stream conduit is configured to combine said first liquid portion of said first liquid stream with a portion of said liquid reflux stream to form said combined liquid stream and to introduce said combined liquid stream into said upper absorber liquid inlet;

a first vapor conduit configured to transport the entire first residue gas stream from said first vapor-liquid separation vessel, wherein said first vapor conduit is in fluid flow communication with said first upper vapor outlet of said first vapor-liquid separation vessel;

a second vapor conduit configured to transport at least a portion of said second residue gas vapor stream from said third vapor-liquid separation vessel, wherein said second vapor conduit is in fluid flow communication with said vapor outlet of said third vapor-liquid separation vessel;

a combined gas conduit configured to receive and combine said first residue gas stream and at least a portion of said second residue gas vapor stream withdrawn from said third vapor-liquid separation vessel to form a combined residue gas stream, wherein said combined gas conduit is in fluid flow communication with said first and said second vapor conduits;

a first warming pass disposed within said primary heat exchanger, wherein said first warming pass warms the combined residue gas stream, wherein said first warming pass is in fluid flow communication with said combined gas conduit; and a single closed-loop mixed refrigeration cycle, said cycle comprising— a refrigerant compressor defining a suction inlet and a discharge outlet for compressing a stream of mixed refrigerant;

a first refrigerant cooling pass in fluid flow communication with said discharge outlet of said refrigerant compressor, said first refrigerant cooling pass being disposed in said primary heat exchanger and cools at least a portion of the compressed stream of mixed refrigerant;

an expansion device defining a high pressure inlet and a low pressure outlet for expanding the cooled mixed refrigerant stream, wherein said high pressure inlet is coupled in fluid flow communication with said first refrigerant cooling pass;

a first refrigerant warming pass in fluid flow communication with said low pressure outlet of said expansion device, said first refrigerant warming pass being disposed within said primary heat exchanger and warms the expanded mixed refrigerant stream via indirect heat exchange with the compressed mixed refrigerant stream in said first refrigerant cooling pass and/or the compressed feed gas stream in said first cooling pass, wherein said first refrigerant warming pass is in fluid flow communication with said suction inlet of said refrigerant compressor.

14. The facility of claim 13, further comprising a refrigerant condenser defining a warm refrigerant inlet and a cool refrigerant outlet; a refrigerant separator defining a fluid inlet, a vapor outlet, and a liquid outlet; and a refrigerant mixing point, wherein said discharge outlet of said refrigerant compressor is coupled in fluid flow communication with said warm refrigerant inlet of said refrigerant condenser and said fluid inlet of said refrigerant separator is coupled in fluid flow communication with said cool refrigerant outlet of said refrigerant condenser, wherein said refrigerant separator separates an at least partially condensed refrigerant stream introduced into said refrigerant separator via said fluid inlet into a refrigerant vapor stream withdrawn from said vapor outlet and a refrigerant liquid stream withdrawn from said liquid outlet, wherein said refrigerant mixing point combines at least a portion of said refrigerant vapor stream with at least a portion of said refrigerant liquid stream prior to or within said first refrigerant cooling pass.

15. The facility of claim 13, further comprising a cracking unit located upstream of said NGL recovery facility, wherein at least a portion of said hydrocarbon-containing feed gas originates from said cracking unit.

* * * * *